US007021477B2

(12) United States Patent
Wolfe

(10) Patent No.: US 7,021,477 B2
(45) Date of Patent: Apr. 4, 2006

(54) CHILD-RESISTANT CLOSURE AND CONTAINER PACKAGE

(75) Inventor: Steven R. Wolfe, Maumee, OH (US)

(73) Assignee: Owens-Illinois Prescription Products, Inc., Toledo, OH (US)

( * ) Notice: Subject to any disclaimer, the term of this patent is extended or adjusted under 35 U.S.C. 154(b) by 189 days.

(21) Appl. No.: 10/378,441

(22) Filed: Mar. 3, 2003

(65) Prior Publication Data

US 2004/0173562 A1 Sep. 9, 2004

(51) Int. Cl.
*B65D 55/02* (2006.01)

(52) U.S. Cl. ..... 215/222; 215/332; 215/344; 215/211; 215/DIG. 1

(58) Field of Classification Search ..... 215/211, 215/222, 228, 342, DIG. 1, 321, 332, 344, 215/43, 216
See application file for complete search history.

(56) References Cited

U.S. PATENT DOCUMENTS

| | | | | |
|---|---|---|---|---|
| 3,072,276 A | | 1/1963 | Nichols | |
| 3,339,770 A | * | 9/1967 | Weigand | 215/214 |
| 3,344,942 A | | 10/1967 | Hedgewick | |
| 3,360,149 A | * | 12/1967 | Roth | 215/344 |
| 3,435,975 A | | 4/1969 | Weigand | |
| 3,557,985 A | * | 1/1971 | St. Denis et al. | 215/222 |
| RE27,156 E | | 7/1971 | Hedgewick | |
| 3,608,764 A | | 9/1971 | Hedgewick | |
| 3,613,928 A | | 10/1971 | Landen | |
| 3,753,510 A | | 8/1973 | Hedgewick | |
| 3,880,313 A | | 4/1975 | Akers | |
| 3,880,314 A | | 4/1975 | Akers | |
| 3,917,096 A | * | 11/1975 | Hedgewick | 215/211 |
| 3,951,289 A | | 4/1976 | Landen | |
| 3,974,928 A | | 8/1976 | Domaracki | |
| 4,049,148 A | | 9/1977 | Suhr | |
| 4,053,078 A | | 10/1977 | Herr | |

(Continued)

FOREIGN PATENT DOCUMENTS

EP 0423935 4/1991

(Continued)

*Primary Examiner*—Nathan J. Newhouse
*Assistant Examiner*—James Smalley

(57) ABSTRACT

A child-resistant package includes a container having an end with an open mouth surrounded by a container wall having a central axis. An external ledge extends around the container wall at a position spaced from the open mouth. The ledge has an axially facing surface that adjoins a radially outwardly facing surface of the container wall, and closure securement structure on the ledge including at least one pocket. A closure includes a base wall, a peripheral skirt coupled to the base wall, at least one internal lug on the skirt for receipt in the at least one pocket on the container, and an annular wall that extends from the base wall for plug-sealing receipt within the container mouth when the skirt is received over the end of the container. At least one spring element extends from the base wall of the closure adjacent to the skirt radially inwardly and axially within the skirt. The spring element is adapted to engage the axially facing surface of the ledge and to slide radially inwardly along the ledge surface as the closure lug is moved into the pocket on the container to bias the lug into the pocket. The radially outwardly facing surface of the container wall adjacent to the ledge axially facing surface functions as a stop to prevent over-compression of the spring element, and to prevent engagement of the spring element with the annular wall on the closure and thereby affect the plug seal function of the annular wall.

22 Claims, 10 Drawing Sheets

U.S. PATENT DOCUMENTS

| | | | | | |
|---|---|---|---|---|---|
| 4,091,948 | A | | 5/1978 | Northup | |
| 4,128,184 | A | * | 12/1978 | Northup | 215/222 |
| RE30,625 | E | | 5/1981 | Akers | |
| 4,346,809 | A | | 8/1982 | Kusz | |
| 4,397,397 | A | | 8/1983 | Herr | |
| 4,434,915 | A | * | 3/1984 | Kirk, Jr. | 222/153.13 |
| 4,444,327 | A | | 4/1984 | Hedgewick | |
| 4,526,281 | A | * | 7/1985 | Herr | 215/211 |
| 4,567,992 | A | | 2/1986 | Davis | |
| 4,579,238 | A | * | 4/1986 | Herr | 215/211 |
| 4,726,484 | A | * | 2/1988 | Lutz | 215/329 |
| 4,823,967 | A | * | 4/1989 | Thompson | 215/222 |
| 5,135,124 | A | * | 8/1992 | Wobser | 215/222 |
| 5,449,078 | A | * | 9/1995 | Akers | 215/222 |
| 5,738,231 | A | * | 4/1998 | Montgomery | 215/44 |
| 5,927,532 | A | * | 7/1999 | Traub | 215/342 |
| 5,938,055 | A | | 8/1999 | Philips | |
| 5,967,350 | A | | 10/1999 | Jones | |
| 6,161,711 | A | * | 12/2000 | Miceli et al. | 215/206 |
| 6,378,713 | B1 | * | 4/2002 | Montgomery | 215/222 |
| 6,446,823 | B1 | * | 9/2002 | Miceli et al. | 215/228 |
| 6,874,648 | B1 | * | 4/2005 | Willingham et al. | 215/344 |
| 2001/0019033 | A1 | | 9/2001 | Montgomery | |
| 2001/0035388 | A1 | | 11/2001 | Miceli et al. | |

FOREIGN PATENT DOCUMENTS

| | | |
|---|---|---|
| EP | 0440361 | 8/1991 |
| JP | 4215960 | 2/1990 |
| WO | 8810218 | 12/1988 |

* cited by examiner

CHILD-RESISTANT CLOSURE AND CONTAINER PACKAGE

The present invention relates to child-resistant closure and container packages, such as prescription packages for example, to closures and containers for such packages, and to methods of making such packages.

Reference is made to U.S. application Ser. Nos. 10/768,374, 10/388,293, 10/386,192, 10/684,724 and 10/378,434, all assigned to the assignee of the present application.

BACKGROUND AND SUMMARY OF THE INVENTION

U.S. Pat. Nos. 4,057,159, 4,059,198 and 4,485,932 disclose child-resistant closure and container packages that include a container or vial, a closure, and a spring/seal disk arrangement disposed between the closure and the container. The closure has lugs on an inside surface of a skirt that cooperate with external locking notches or pockets on projections around the mouth of the container for securing the closure to the container. An internal abutment on the closure cooperates with the spring/seal disk arrangement to urge the closure away from the container so that the lugs are resiliently captured within the pockets. When it is desired to remove the closure, the closure must be pushed toward the container against the force of the disk arrangement so that the lugs clear the pockets, and then turned counterclockwise. When the closure is assembled to the container, the lugs cam beneath cam surfaces on the projections against the force of the disk arrangement until the lugs snap into the pockets on the projections.

Although the closure and container packages disclosed in the noted patents have enjoyed substantial commercial acceptance and success, improvements remain desirable. For example, it is desirable to provide the closure and container package as a two-piece assembly, rather than as a three-piece or four-piece assembly, by eliminating any need for separate spring/seal disk(s). In addition, it can be difficult for adults with impaired dexterity to close the package, or to push and turn the closure with respect to the container to open the package for access to the contents. It is a general object of the present invention to provide a closure and container package, a closure and a container for use in such a package, and/or a method of making such a package, in which the package is as a two-piece assembly, and in which in the preferred embodiments the closure can be secured to the container in a non-child-resistant mode of operation for use by adults with impaired manual dexterity when child-resistance is not needed.

The present invention embodies a number of aspects that can be implemented separately from or, more preferably, in combination with each other.

A package in accordance with one aspect of the present invention includes a container having an end with an open mouth surrounded by a container wall having a central axis. An external ledge extends around the container wall at a position spaced from the open mouth. The ledge has an axially facing surface that adjoins a radially outwardly facing surface of the container wall, and closure securement structure on the ledge including at least one pocket. A closure includes a base wall, a peripheral skirt coupled to the base wall, at least one internal lug on the skirt for receipt in the at least one pocket on the container, and an annular wall that extends from the base wall for plug-sealing receipt within the container mouth when the skirt is received over the end of the container. At least one spring element extends from the base wall of the closure adjacent to the skirt radially inwardly and axially within the skirt. The spring element is adapted to engage the axially facing surface of the ledge and to slide radially inwardly along the ledge surface as the closure lug is moved into the pocket on the container and the spring element is compressed to bias the lug into the pocket. The radially outwardly facing surface of the container wall adjacent to the ledge axially facing surface functions as a stop to prevent over-compression of the spring element, and to prevent engagement of the spring element with the annular wall on the closure and thereby affect the plug seal function of the annular wall.

A package in accordance with a second aspect of the invention includes a container having an end with an open mouth surrounded by a container wall with a central axis. An external ledge on the container wall is spaced from the open mouth. Closure securement structure is provided on a radially outwardly facing surface of the ledge, and includes a plurality of angularly spaced pockets opening away from the end of the container. A closure includes an annular base wall with inner and outer circular concentric peripheries. A skirt extends from the outer periphery and has a plurality of angularly spaced internal lugs. A first annular wall extends from the base wall within the skirt. A dome-has a second annular wall that extends from the inner periphery of the base wall in a direction opposite from the skirt. A plurality of spring elements extend from the base wall adjacent to the skirt radially inwardly and axially within the skirt. The spring elements engage an axially facing surface of the ledge to bias the lugs into the pockets when the skirt is received over the container end, the spring elements are compressed and the first annular wall is in plug-sealing engagement with the container mouth in a child-resistant mode of operation. A radially outwardly surface of the container wall functions as a stop against over-compression of the spring elements and to prevent abutment of the spring elements with the first annular wall of the closure. The projection is received within the container mouth in a non-child-resistant mode of operation, with the second annular wall functioning as a plug seal within the container mouth.

BRIEF DESCRIPTION OF THE DRAWINGS

The invention, together with additional objects, features, advantages and aspects thereof, will be best understood from the following description, the appended claims and the accompanying drawings in which:

DETAILED DESCRIPTION OF PREFERRED EMBODIMENTS

FIGS. 1–4 illustrate a closure and container package 32 in accordance with one exemplary but presently preferred embodiment of the invention as including a container 34 to which a closure 36 is secured. Container 34 is of one-piece molded construction of a suitable plastic such as polypropylene. Likewise, closure 36 is of one-piece molded plastic construction of suitable resin material such as polypropylene. However, description of closure and container packages of the present application as comprising a one-piece container and a one-piece closure does not preclude inclusion of other elements in the package, such as a device to hold down pelletized products such as pills within the container, etc. Likewise, although the preferred embodiments of the invention constitute prescription-type packages, the principles of the invention can be implemented in other types of packages as well, such as vitamin or aspirin packages.

Figure 1:
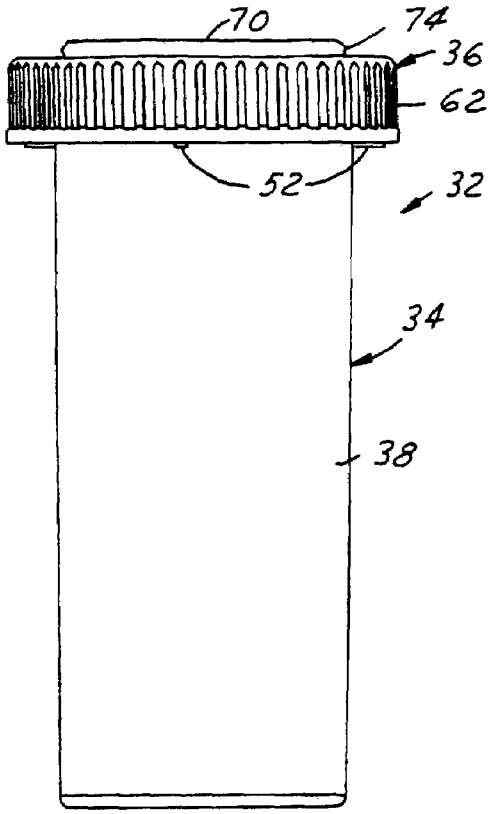
FIG. 1 is an elevational view of a package in accordance with a first exemplary preferred embodiment of the present invention in a child-resistant mode of operation.
Figure 5A:
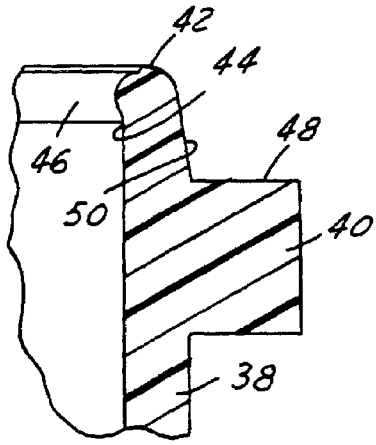
FIG. 5A is a fragmentary sectional view on an enlarged scale of the portion of FIG. 5 within the area 5A.
Figure 5:
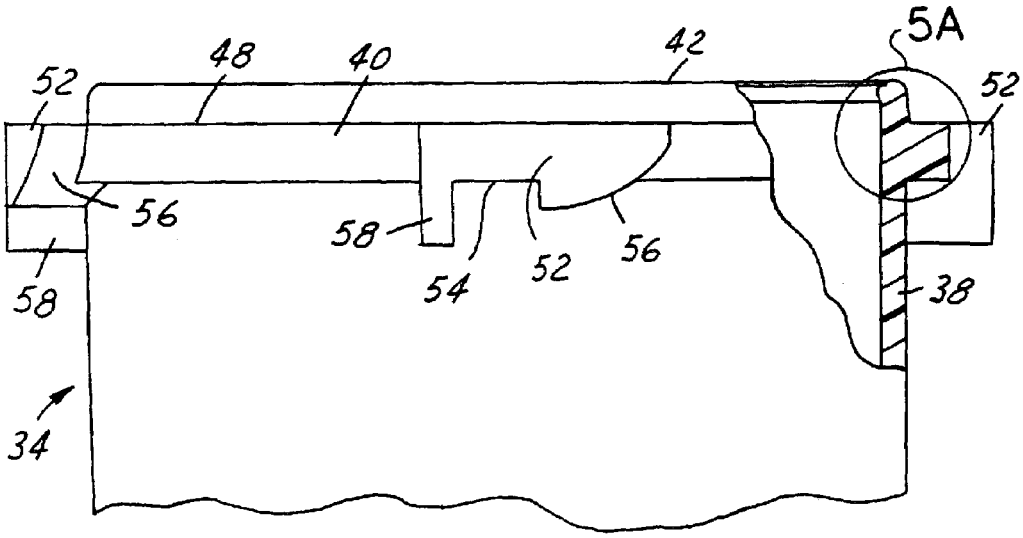
FIG. 5 is fragmentary partially sectioned elevational view of the container in the package of FIGS. 1–4.
Figure 4:
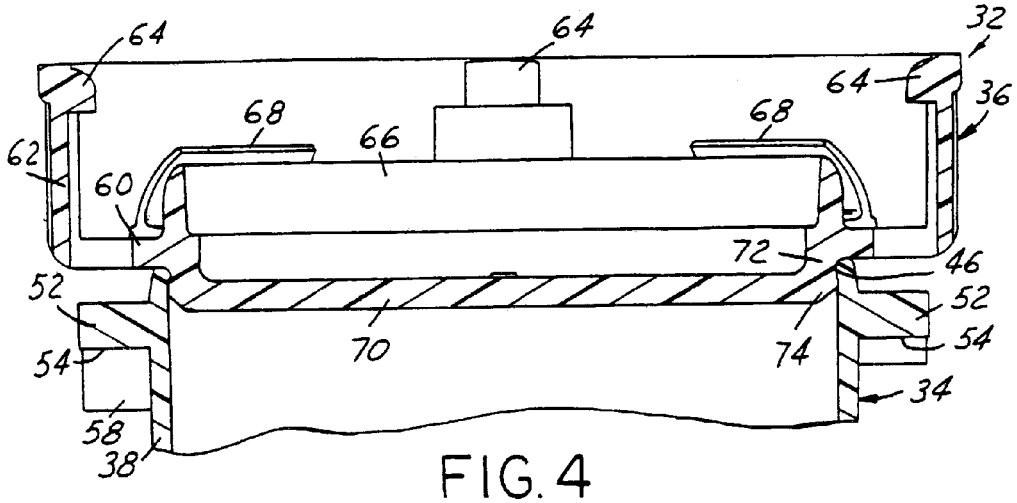
FIG. 4 is a fragmentary sectional view that is similar to those of FIGS. 2 and 3 but illustrates the package in a non-child-resistant mode of operation.
Figure 2:
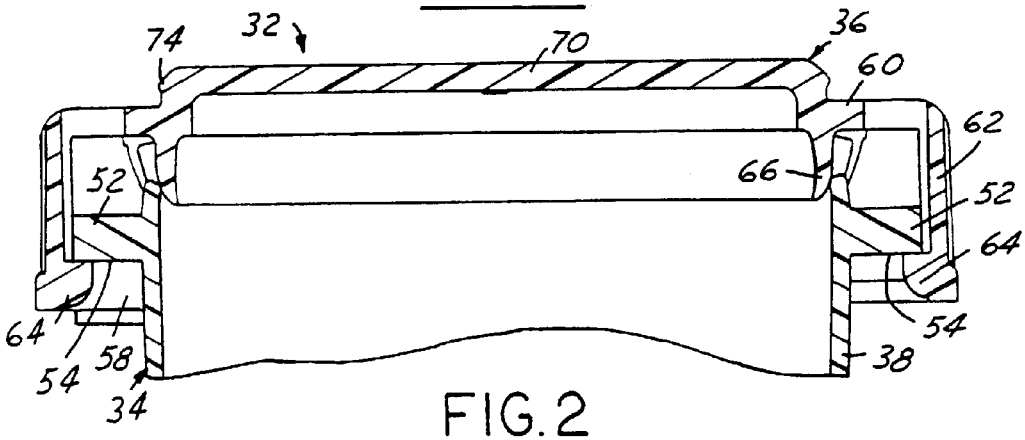
FIG. 2 is a fragmentary sectional view of the package in FIG. 1.
Figure 3:
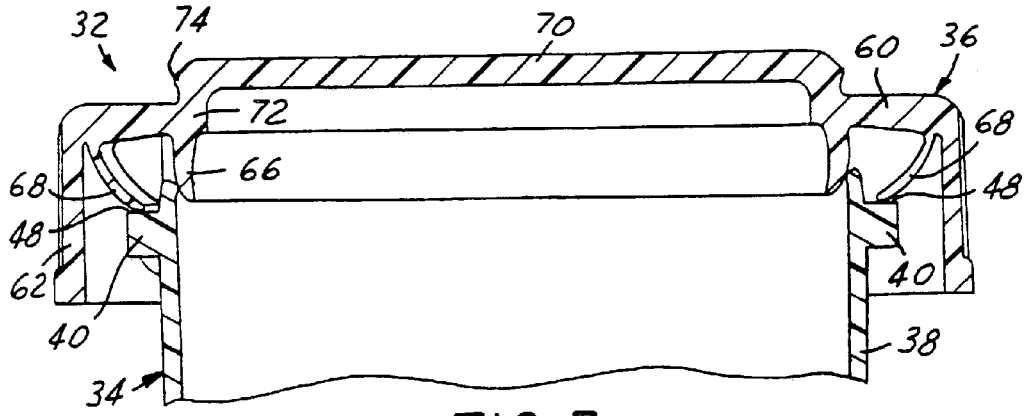
FIG. 3 is a fragmentary sectional view which is similar to that of FIG. 2 but taken at a position angularly spaced from that in FIG. 2.
Figure 7:
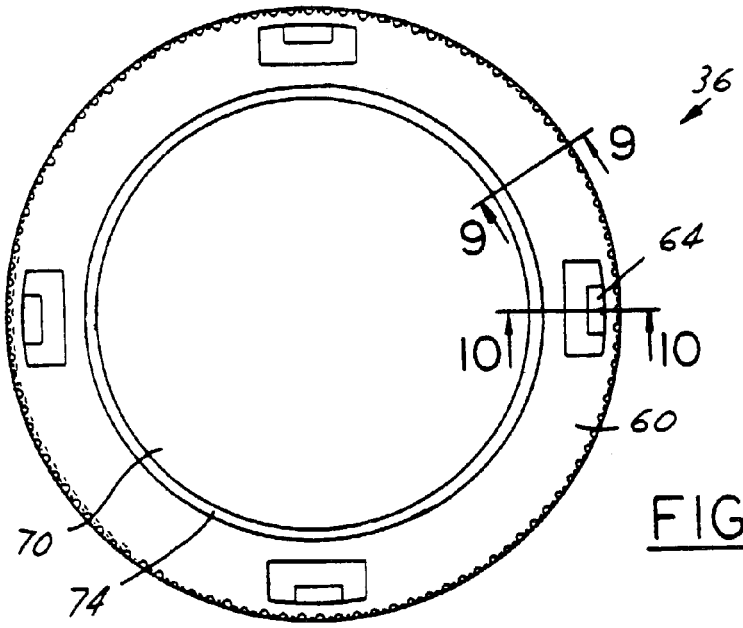
FIG. 7 is a top plan view of the closure in FIG. 6.
Figure 6:
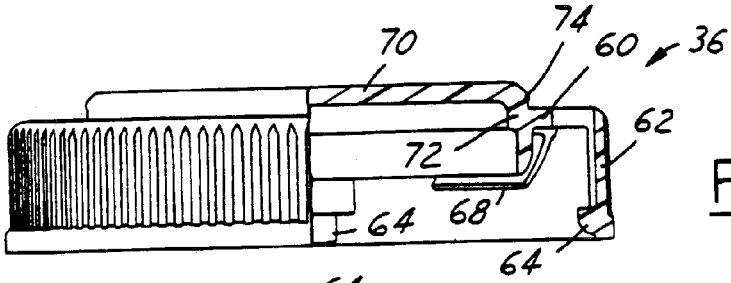
FIG. 6 is a partially sectioned elevational view of the closure in the package of FIGS. 1–4.
Figure 8:
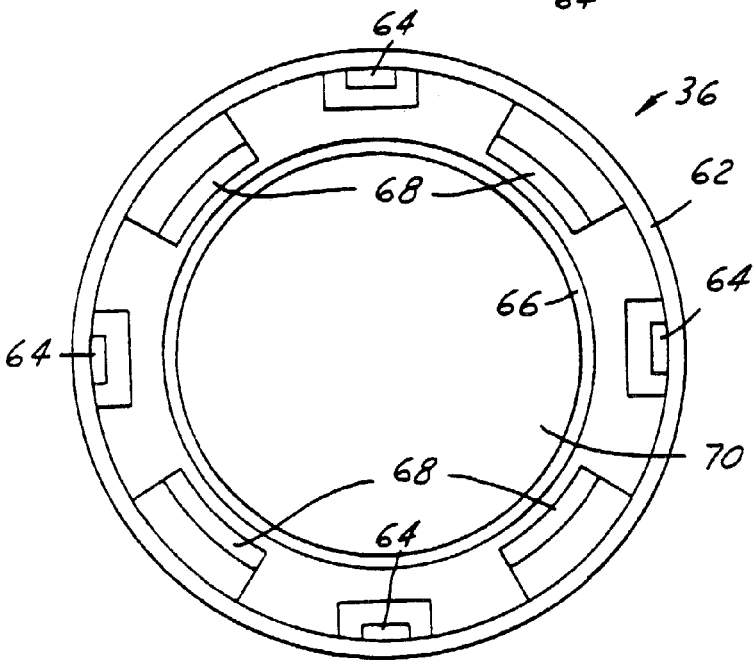
FIG. 8 is a bottom plan view of the closure in FIG. 6.

In accordance with one aspect of the present invention, closure 36 may be secured to container 34 in a child-resistant mode of operation as illustrated in FIGS. 1–3, or in a non-child-resistant mode of operation as illustrated in FIG. 4. Referring to FIGS. 1–5A, container or vial 34 includes a sidewall 38. A circumferential external ledge 40 extends entirely around the outer surface of container wall 38 and projects radially outwardly therefrom. Ledge 40 is spaced from the upper end 42 of container wall 38, which surrounds and defines the open mouth 44 of the container. (Directional words such as "upper" and "lower" are employed by way of description and not limitation with respect to the upright orientation of the container illustrated in FIGS. 1–5A, and the child-resistant orientation of the closure illustrated in FIGS. 1–3 and 6. Directional words such as "axial" and "circumferential" are employed by way of description and not limitation with respect to the axis of the closure or the container as appropriate.) A circumferential bead 46 extends radially inwardly from container wall 38 around open mouth 44 for purposes to be described. Bead 46 may be circumferentially continuous or segmented. Ledge 40 has an upper surface 48, which preferably is substantially planar and perpendicular to the axis of the container. Surface 48 preferably is at the parting line of the mold for making the container and faces in the axial direction toward container end 42. Axially facing surface 48 adjoins a substantially radially facing surface 50 of container wall 38 that extends from ledge 40 to upper container wall end 42. In the illustrated exemplary embodiment of the invention, surface 50 tapers away from surface 48 in an angular direction. A circumferential array of angularly spaced locking projections 52 extend radially outwardly from ledge 40. Each projection 52 includes a downwardly opening notch or pocket 54, a cam surface 56 in the counterclockwise direction from pocket 54 as viewed from the top of the container, and a stop leg 58 at the clockwise edge of pocket 54. Cam surface 56 is convex in the embodiment of the invention illustrated in FIG. 5.

Figure 9:
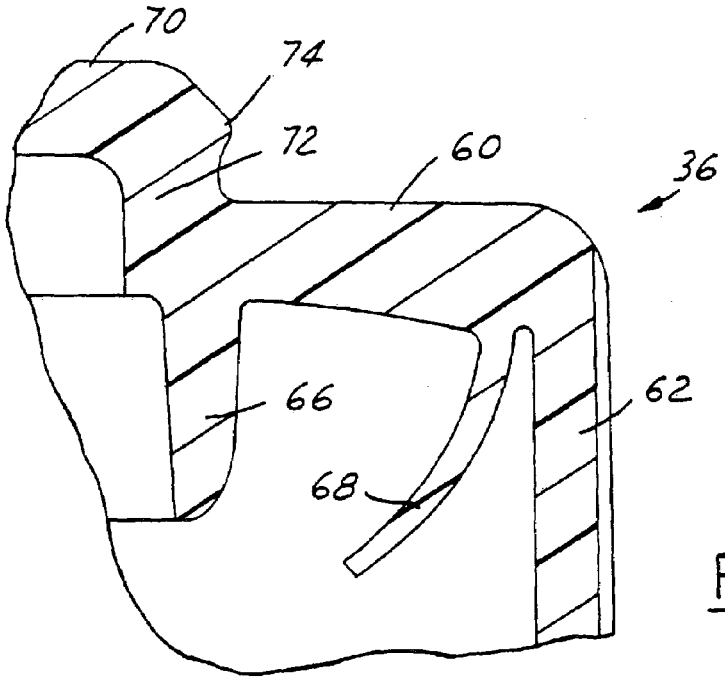
FIGS. 9 and 10 are fragmentary sectional views taken substantially along the respective lines 9—9 and 10—10 in FIG. 7.
Figure 10:
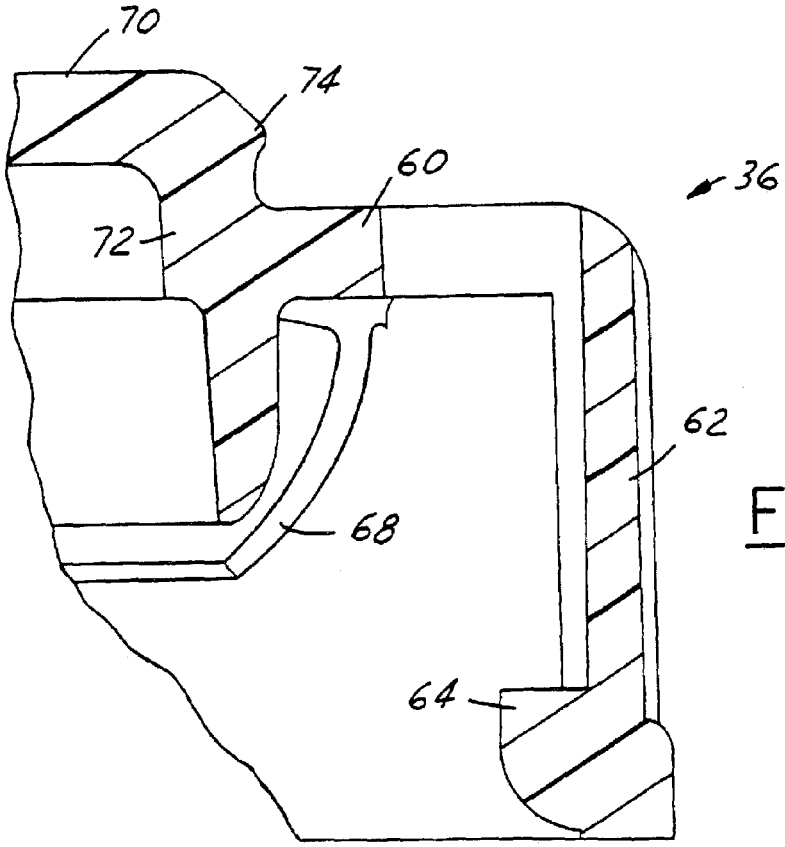
Figure 11:
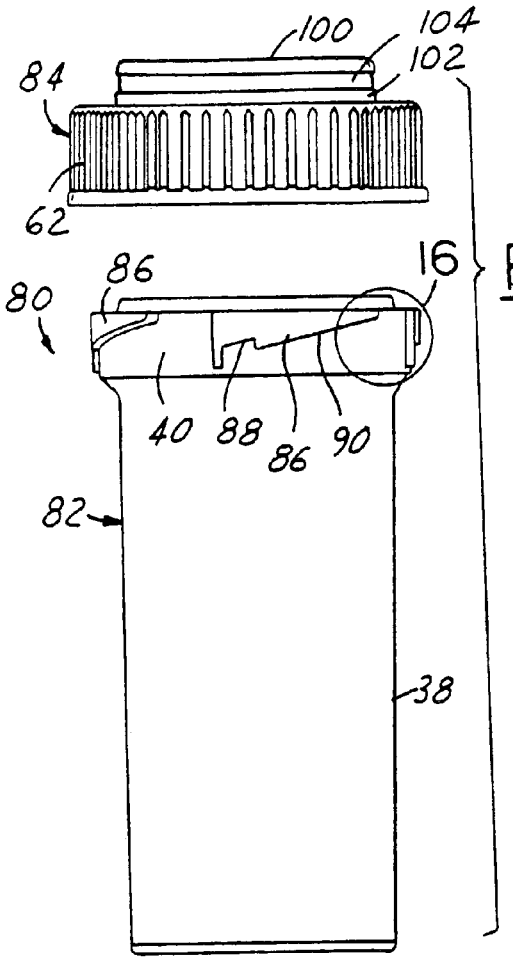
FIG. 11 is an exploded elevational view of a package in accordance with a second exemplary preferred embodiment of the invention.
Figure 16:
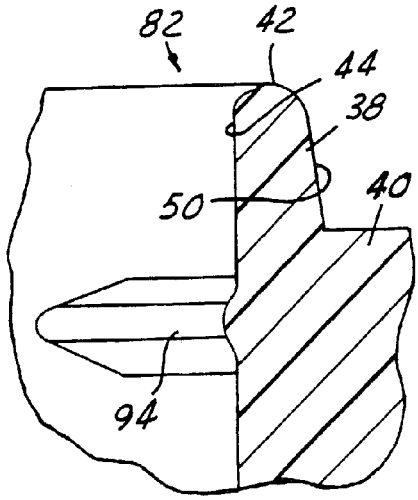
FIG. 16 is a fragmentary sectional view of the portion of the container within the area 16 in FIG. 11.
Figure 15:
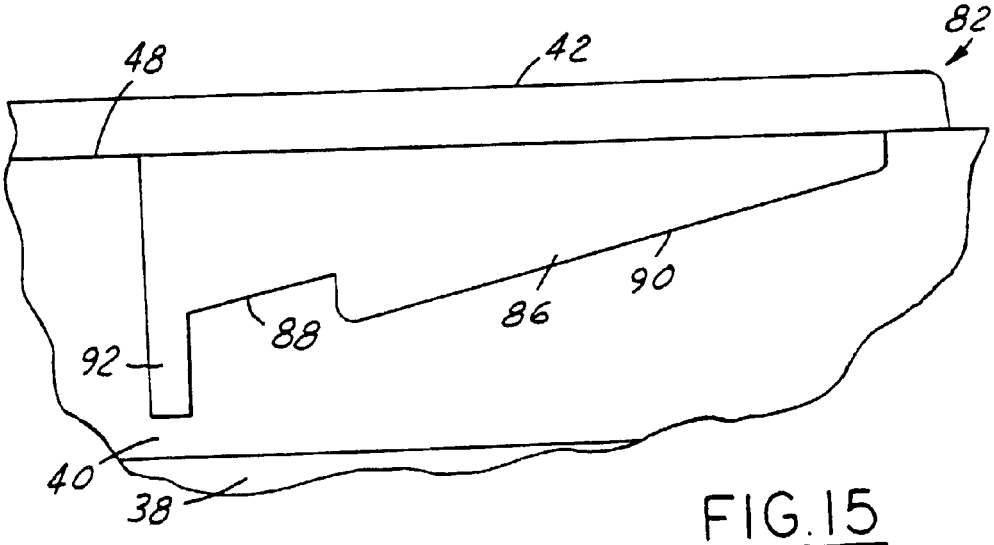
FIG. 15 is a fragmentary elevational view of the container in the package of FIGS. 11–14.

Referring now to FIGS. 1–4 and 6–10, closure 36 includes an annular base wall 60. Base wall 60 is planar in the preferred embodiments of the invention, having inner and outer concentric circular peripheral edges. A cylindrical skirt 62 extends from the outer peripheral edge of base wall 60 coaxially with the central axis of the closure. A circumferential array of angularly spaced locking lugs 64 are disposed on the inner surface of skirt 62 for receipt in corresponding pockets 54 (FIG. 5) as will be described. A first annular wall 66 extends axially from base wall 60 coaxially with skirt 62 and spaced radially inwardly from the skirt. Wall 66 extends from a position at or near the inner peripheral edge of annular base wall 60 in the preferred embodiments of the invention. Wall 66 tapers narrowingly away from base wall 60 in the preferred embodiments of the invention, having a rounded outside free edge for engaging the container mouth. A circumferential array of spring tabs or elements 68 integrally extend from base wall 60 at angularly spaced positions adjacent to skirt 62 and the outer peripheral edge of the base wall. Spring elements 66 are arcuate in radial cross section, as best seen in FIG. 9, and extend radially inwardly and axially downwardly from the base wall adjacent to and within skirt 62. In the embodiment of the closure illustrated in FIG. 8, there are four locking lugs 64 at 90° spacing from each other, and four spring elements 68 at 90° spacing from each other and 45° spacing from the locking lugs. As best seen in FIG. 9, the axial thickness of base wall 60 preferably increases from a first thickness adjacent to wall 66 to a second thickness, greater than the first thickness, at spring elements 68. This increased thickness of base wall 60 adjacent to the spring elements strengthens the base wall against flexure as the closure is secured to the container. A hollow or solid plug or projection 70 includes a second annular wall 72 that extends from the inner periphery of base wall 60 coaxial with but in an opposite direction from skirt 62. Thus, second annular wall 72 is spaced radially inwardly from skirt 62, as well as being positioned on the opposite side of base wall 60. A circumferential bead 74 extends radially outwardly from wall 72. Bead 74 preferably is circumferentially continuous, but may be circumferentially discontinuous.

In assembly of closure 36 to container 34 in a child-resistant mode of operation (FIGS. 1–3), closure 36 is positioned over the end of container wall 38, with skirt 62 externally surrounding ledge 40 and projections 52, and with first annular wall 66 in alignment with container mouth 44. Spring elements 68 are brought into engagement with axially facing surface 48 of ledge 40. As the closure is rotated clockwise from this position and closure lugs 64 ride along container cam surfaces 56, spring elements 68 are compressed and slide radially inwardly along upper surface 48 of ledge 40. At the same time, annular wall 66 is brought into plug sealing engagement with container mouth 44, resiliently flexing radially inwardly as illustrated in FIGS. 2 and 3. When closure lugs 64 register with pockets 54 on container projections 52, the lugs snap into the pockets and are resiliently retained within the pockets by the residual compression of spring elements 68. Stops 58 on lugs 52 prevent inadvertent turning of the closure clockwise past registry with pockets 54. The portion of container wall 38 between ledge 40 and upper container wall end 42 functions as a stop against over-compression of spring elements 68. That is, compression of the spring elements beyond what is needed to bring the closure lugs into registry with the container pockets causes the free ends of the spring elements to slide radially inwardly along upper surface 48 of ledge 40 into abutment with outer surface 50 of container wall 38. This prevents further compression of the spring elements beyond their elastic limits. Furthermore, this upper portion of the container wall also prevents the spring elements from engaging plug seal wall 66, and potentially breaking the plug seal engagement between wall 66 and the mouth of the container. When it is desired to remove the closure in the child-resistant mode of operation, closure 36 is pushed downwardly against the force of spring elements 66 until closure lugs 64 clear container pockets 54, at which point the closure may be rotated counterclockwise and then removed axially from the container.

FIG. 4 illustrates use of closure 36 in a non-child-resistant mode of operation. Where child resistance is not needed, closure 36 may be inverted, and closure projection 70 inserted into the open mouth of the container. Bead 74 on projection 70 snaps over bead 46 at container mouth 44 to retain the closure by snap-fit in the inverted non-child-resistant orientation. Beads 46, 74 preferably are rounded and positioned such that such snap-fit of closure 36 in the non-child-resistant orientation of FIG. 4 brings the base wall 60 of the closure into abutting end-engagement with the end 42 of the container wall to seal the contents of the package.

FIGS. 11–20 and 21–30 illustrate respective exemplary alternative embodiments of the present invention. Reference numerals in FIGS. 1–30 that are identical to those employed in FIGS. 1–10 indicate similar components. The discussion of FIGS. 11–30 will concentrate on differences between those embodiments and that of FIGS. 1–10.

Figure 14:
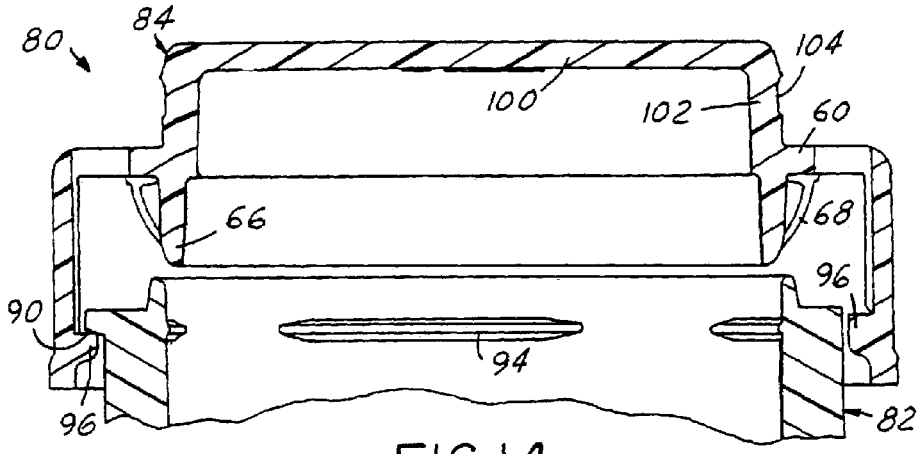
FIG. 14 is a fragmentary sectional view of the embodiment of FIG. 11 at an intermediate stage of assembly.
Figure 12:
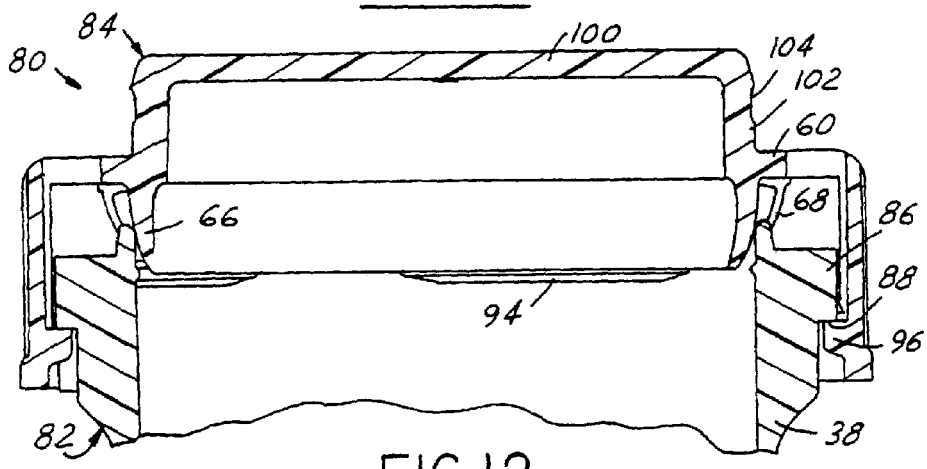
FIGS. 12 and 13 are fragmentary sectional views that are respectively similar to FIGS. 2 and 3 but of the embodiment of the invention illustrated in FIG. 11.
Figure 13:
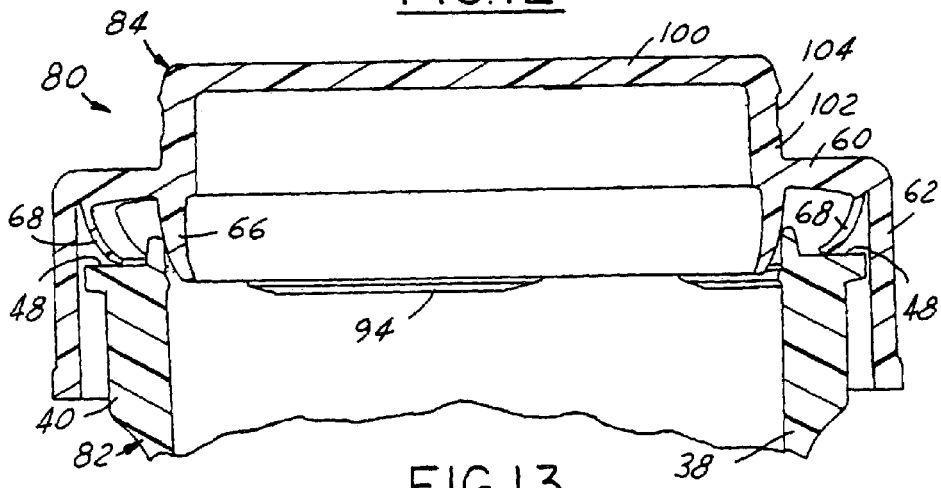
Figure 17:
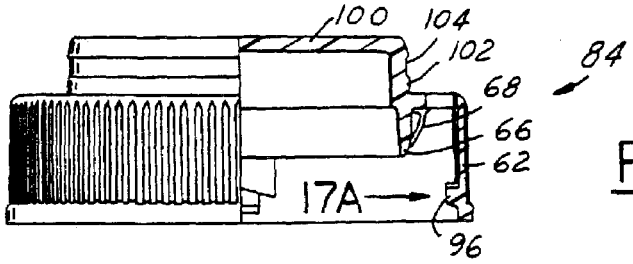
FIG. 17 is a partially sectioned elevational view of the closure in the package of FIGS. 11–14.
Figure 18:
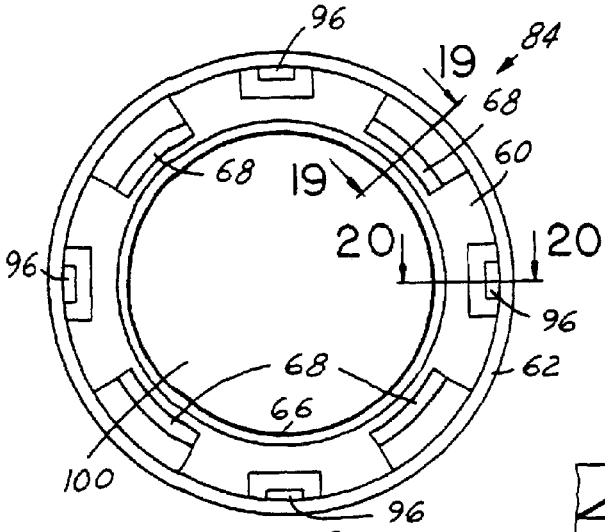
FIG. 18 is a bottom plan view of the closure in FIG. 17.
Figure 17A:
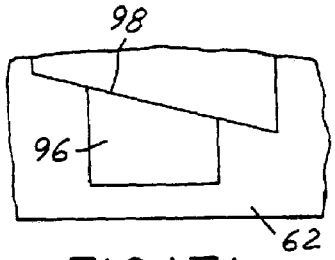
FIG. 17A is a fragmentary elevational view taken substantially from the direction 17A in FIG. 17.
Figure 19:
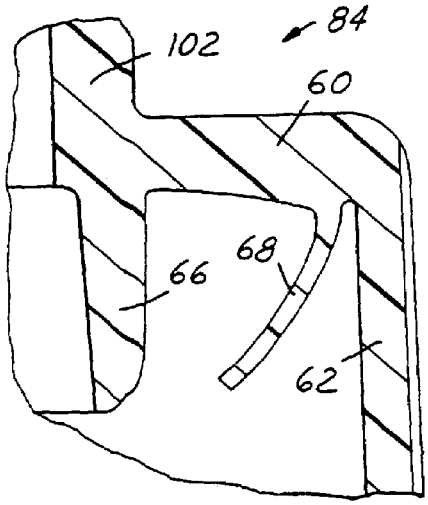
FIGS. 19 and 20 are fragmentary sectional views taken substantially along the respective lines 19—19 and 20—20 in FIG. 18.
Figure 20:
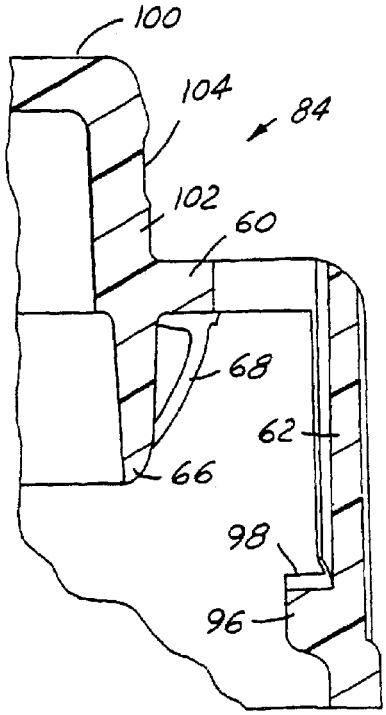
Figure 21:
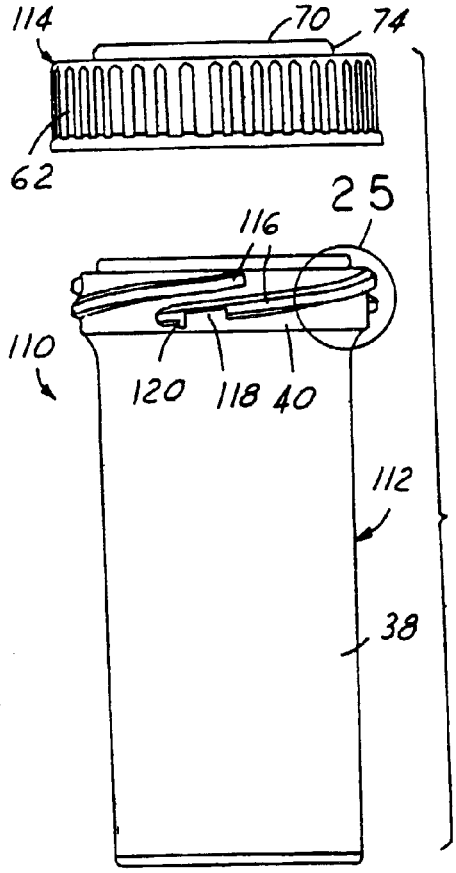
FIG. 21 is an exploded elevational view of a package in accordance with a third exemplary preferred embodiment of the invention.
Figure 25:
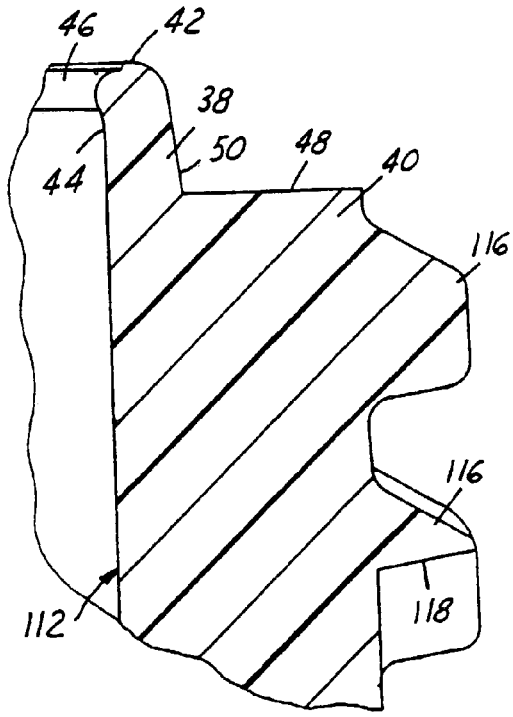
FIG. 25 is a fragmentary sectional view of the portion of the container within the area 25 in FIG. 21.
Figure 26:
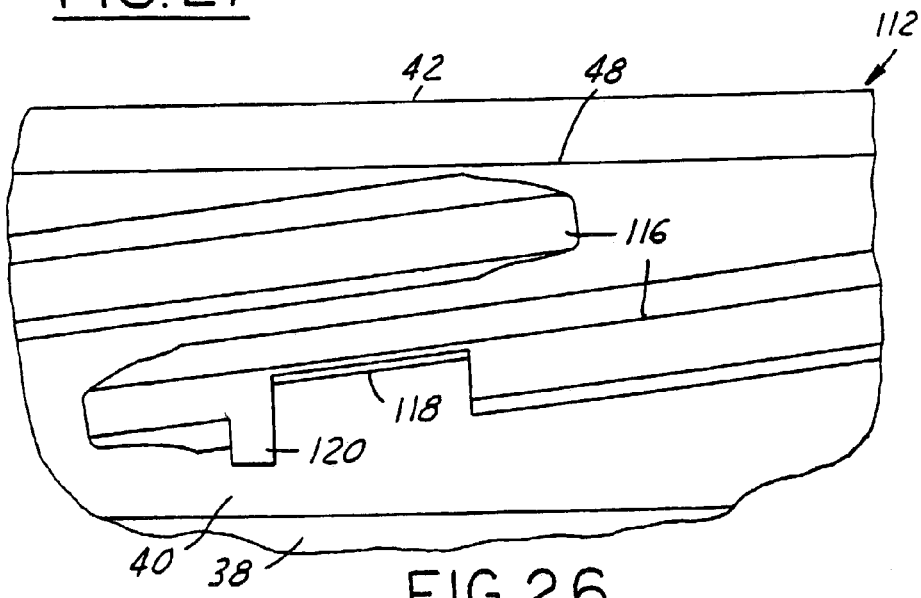
FIG. 26 is a fragmentary elevational view on an enlarged scale of a portion of the container in FIG. 21.

FIGS. 11–20 illustrate a package 80 in accordance with a second exemplary but presently preferred embodiment of the invention. Package 80 includes a container 82 and a closure 84. In container 82 of package 80, a circumferential array of angularly spaced projections 86 extend radially outwardly from ledge 40. Each projection 86 includes an under-pocket 88, a cam surface 90 at the leading edge of the projection, and an abutment wall 92 at the trailing edge of the projection (with respect to clockwise assembly of the closure to the container). Cam surfaces 90 in the embodiment of FIGS. 11–20 are part-helical, rather than convex as in the embodiment of FIGS. 1–10. A segmented bead 94 extends around the inner surface of container wall 38 at a position spaced from wall end 42, and is radially inwardly aligned with ledge 40 in the illustrated embodiment of the invention. The lugs 96 on the inside surface of closure skirt 62 have upper surfaces—i.e., surfaces axially opposed to closure base wall 60—which are angulated and part-helical in geometry, as best seen in FIGS. 17A and 20. These part-helical surfaces 98 slope away from base wall 60 in the clockwise direction as viewed from above. Part-helical lug surfaces 98 cooperate with part-helical projection cam surfaces 90 to facilitate assembly of closure 84 onto container 82, such as by elderly or impaired persons, when a child-resistant mode of operation is still desired. Surfaces 90, 98 may have helix angles of 13.8° with respect to planes perpendicular to the closure and container axes, for example. A projection 100 is coupled to the inner periphery of base wall 60 by an annular wall 102, which is axially extended as compared with annular wall 72 in the embodiment of FIGS. 1–10. A radially outwardly opening circumferential channel 104 is provided on the radially outer surface of wall 102. Channel 104 lies in a plane parallel to but spaced from base wall 60. In a non-child-resistant mode of operation, in which closure 84 is inverted and projection 100 is received within container mouth 44, channel 104 is received by snap-fit over bead 94 within the container mouth. In the child-resistant mode of operation (FIGS. 12–14), operation is the same as discussed above in connection with FIGS. 2–3. FIG. 14 shows how lugs 96 engage projections 86 before spring elements 68 engage ledge surface 48. The same would occur in the embodiment of FIGS. 1–10.

Figure 24:
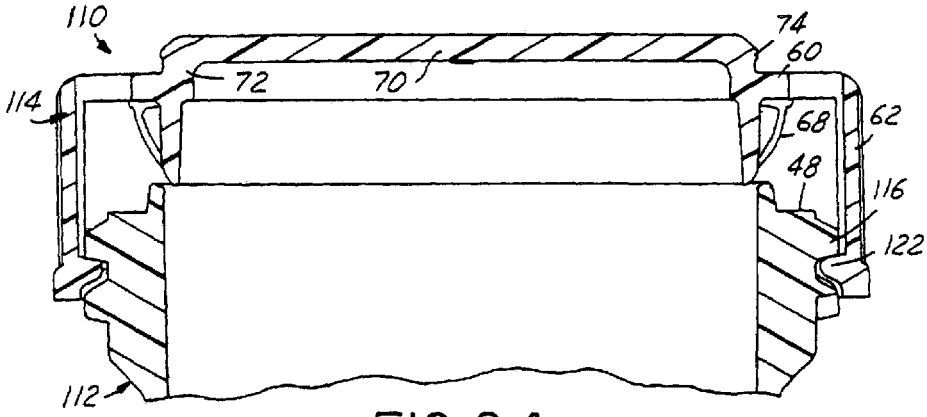
FIG. 24 is a fragmentary sectional view that shows the package of FIG. 21 at a intermediate stage of assembly.
Figure 22:
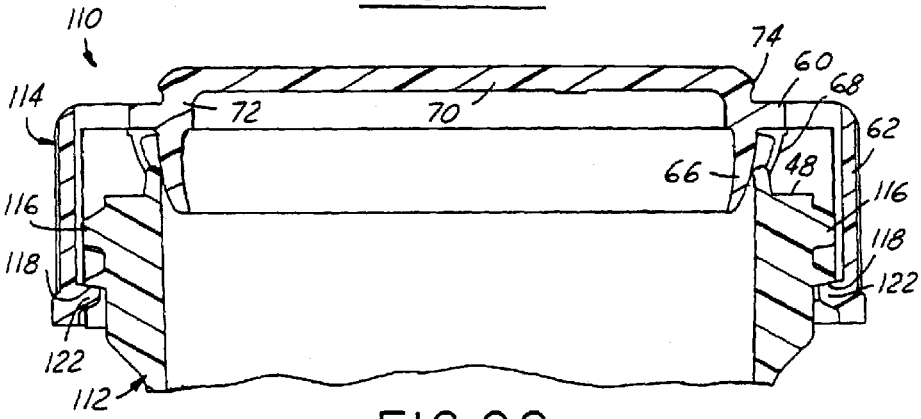
FIGS. 22 and 23 are fragmentary sectional views that are similar to those of FIGS. 2 and 3 but illustrate the embodiment of the invention in FIG. 21.
Figure 23:
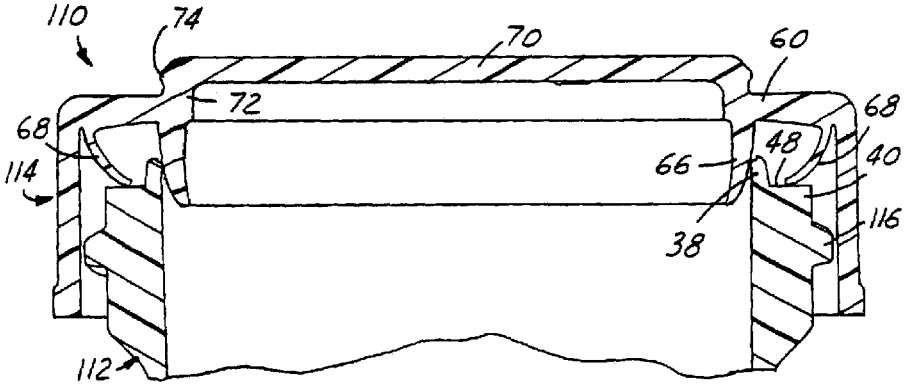
Figure 27:
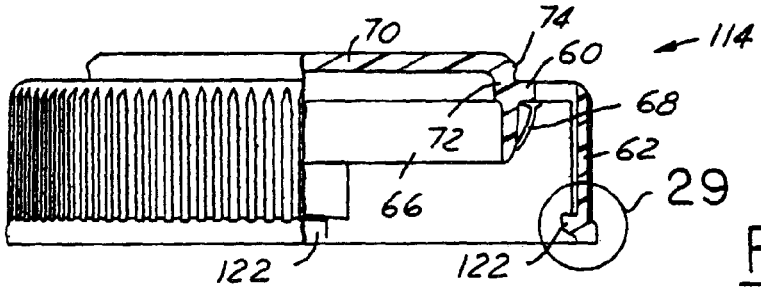
FIG. 27 is a partially sectioned elevational view of the closure in the package of FIGS. 21–24.
Figure 28:
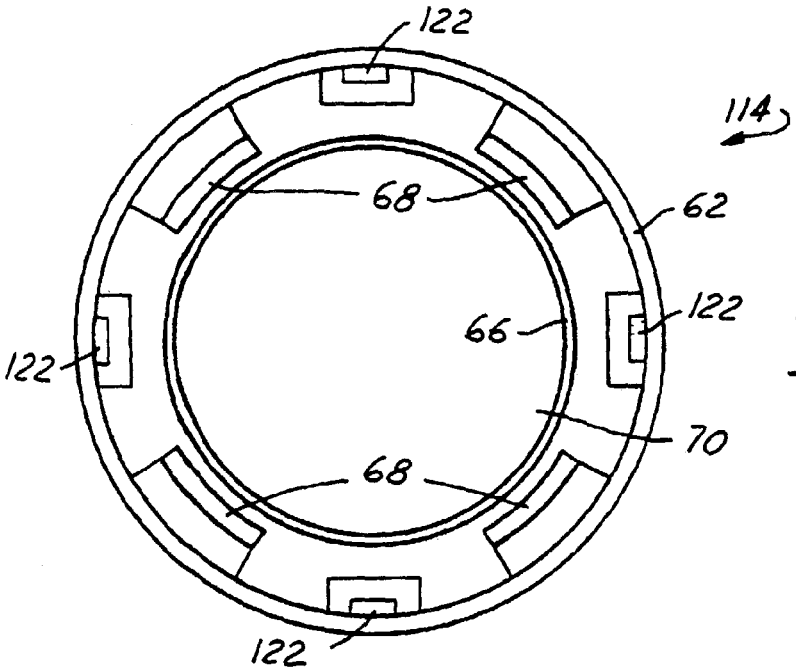
FIG. 28 is a bottom plan view of the closure in FIG. 27.
Figure 29:
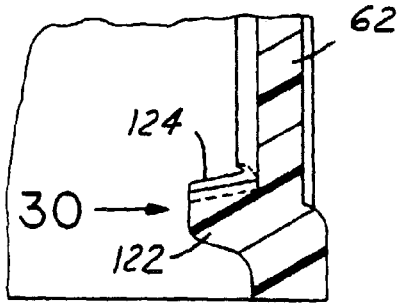
FIG. 29 is a fragmentary sectional view on an enlarged scale of the portion of the closure within the area 29 in FIG. 27.
Figure 30:
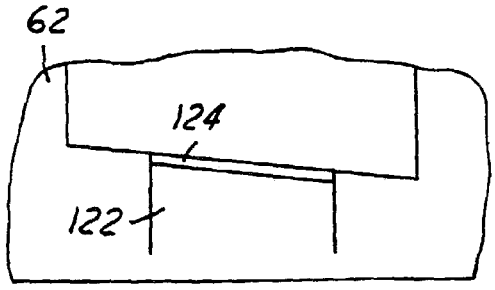
FIG. 30 is a fragmentary elevational view on an enlarged scale taken substantially from the direction 30 in FIG. 29.

FIGS. 21–30 illustrate a closure and container package 110 in accordance with a third exemplary but presently preferred embodiment of the invention. Package 110 includes a container 112 and a closure 114. In this embodiment, a series of external thread segments 116 are formed around the radially outwardly facing surface of ledge 40. Each thread segment 116 has an associated pocket 118 adjacent to the lower end of the thread segment and a thread stop 120 downstream from pocket 118. In the illustrated embodiment of the invention, there are four thread segments 116 and four associated pockets 118 at 90° spacing from each other. The upper end of the container, from ledge surface 48 upward, is essentially the same as in the embodiment of FIGS. 5 and 5A. Closure 114 is essentially the same as closure 36 in FIGS. 1–10, except that the locking lugs 122 on the inside of closure skirt 62 have upper surfaces 124—i.e., surfaces opposed to closure base wall 60—that are part-helical, angling downwardly both away from the base wall and radially inwardly away from the skirt. This geometry of upper surfaces 124 is best seen in FIGS. 29 and 30. The part-helical angle of the lug surface circumferentially of the skirt facilitates assembly of the closure onto the thread segments of the container. The radially inwardly and axially downwardly oriented angle of each upper surface 124 cooperates with the undersurface of each thread segment 116 to facilitate assembly of the closure onto the container. Surfaces 124 may have a circumferential angle of 8° and a radial angle of 10° for example. FIG. 24 illustrates how skirt lugs 122 engage thread segments 116 before spring elements 68 engage ledge surface 48.

There have thus been described a closure and container package, a closure, a container, and a method of making a closure and container package that fully satisfy all of the objects and aims set forth above. The invention has been disclosed in conjunction with three of presently preferred embodiments thereof, and a number of additional modifications and variations have been discussed. Other modifications and variations will readily suggest themselves to persons of ordinary skill in the art. The invention is intended to embrace all such modifications and variations as fall within the spirit and broad scope of the appended claims.

The invention claimed is:

1. A child-resistant package that includes:

a container having an end with an open mouth surrounded by a container wall having a central axis, an external ledge extending around said container wall and spaced from said open mouth, said ledge having an axially facing surface that adjoins a radially outwardly facing surface of said container wall, and means on said ledge including at least one pocket for securing a closure to said container, and a closure that includes a base wall, a peripheral skirt coupled to said base wall, at least one internal lug on said skirt for receipt in said at least one pocket, an annular wall that extends from said base wall for plug-sealing receipt within said mouth when said skirt is received over said end of said container, and at least one spring element that extends from said base wall adjacent to said skirt radially inwardly and axially within said skirt, said spring element being adapted to engage said axially facing surface of said ledge and to slide radially inwardly along said surface as said at least one lug is moved into said pocket and said spring element is compressed to bias said lug into said pocket, said radially outwardly facing surface of said container wall adjacent to said ledge axially facing surface functioning as a stop to prevent over-compression of said spring element and to prevent engagement of said spring element with said annular wall on said closure.

2. The package set forth in claim 1 wherein said at least one spring element is arcuate in radial cross section.

3. The package set forth in claim 1 wherein said at least one spring element comprises a plurality of circumferentially spaced spring elements.

4. The package set forth in claim 1 wherein said base wall has an axial thickness that increases from a first thickness adjacent to said annular wall to a second thickness greater than said first thickness adjacent to said spring element.

5. The package set forth in claim 4 wherein said at least one internal lug on said skirt comprises a plurality of angularly spaced lugs, and wherein said at least one spring element comprises a plurality of angularly spaced spring elements, with each said spring element being angularly positioned between adjacent lugs.

6. The package set forth in claim 1 wherein said means include a plurality of radial projections on said ledge, each said projection having a said pocket on an underside of said projection and a cam surface on one side of said pocket, and wherein said at least one lug on said skirt includes a plurality of lugs adapted to ride over said cam surfaces and be received in said pockets.

7. The package set forth in claim 6 wherein said cam surfaces are convex.

8. The package set forth in claim 6 wherein said cam surfaces are part-helical.

9. The package set forth in claim 8 wherein said lugs have part-helical upper surface portions for riding over said part-helical cam surfaces of said projections.

10. The package set forth in claim 1 wherein said means include at least one external thread on said ledge, said thread having said at least one pocket on an underside of said thread for receiving said at least one lug.

11. The package set forth in claim 10 wherein said at least one external thread includes a plurality of thread segments, each having a said pocket, and wherein said at least one lug includes a plurality of said lugs for riding along undersides of said thread segments and receipt in said pockets.

12. The package set forth in claim 1 wherein said closure includes an annular wall extending from said base wall in a direction opposite from said skirt and at a position spaced radially inwardly from said skirt, said annular wall being adapted to be received within said container mouth for securing said closure to said container in a non-child-resistant mode of operation.

13. A package that includes:

a container having an end with an open mouth surrounded by a container wall having a central axis, an external ledge on said container wall spaced from said open mouth, and means on a radially outwardly facing surface of said ledge for securing a closure to said container, said means including a plurality of angularly spaced pockets opening away from said container end, and a closure that includes an annular base wall with inner and outer circular concentric peripheries, a skirt extending from said outer periphery and having a plurality of angularly spaced internal lugs, a first annular wall that extends from said base wall within said skirt, a projection having a second annular wall that extends from said inner periphery of said base wall in a direction opposite from said skirt, and a plurality of spring elements that extend from said base wall adjacent to said skirt radially inwardly and axially within said skirt, said spring elements engaging an axially facing surface of said ledge when said skirt is received over said container end, said spring elements are compressed and said first annular wall is in plug-sealing engagement with said container mouth in a child-resistant mode of operation to bias said lugs into said pockets, a radially outwardly facing surface of said container wall adjacent to said axially facing surface functioning as a stop against over-compression of said spring elements and to prevent abutment of said spring elements against said first annular wall, said projection being received in said container mouth in a non-child-resistant mode of operation with said second annular wall in plug sealing engagement within said container mouth.

14. The package set forth in claim 13 wherein said spring elements are arcuate in radial cross section.

15. The package set forth in claim 13 wherein said base wall has an axial thickness that increases from a first thickness adjacent to said second annular wall to a second thickness greater than said first thickness adjacent to said spring elements.

16. The package set forth in claim 15 wherein each said spring element is angularly positioned between adjacent lugs.

17. The package set forth in claim 13 wherein said means include a plurality of radial projections on said ledge, each said radial projection having a said pocket on an underside of said projection and a cam surface on one side of said pocket, and wherein said at least one lug on said skirt includes a plurality of lugs adapted to ride over said cam surfaces and be received in said pockets.

18. The package set forth in claim 17 wherein said cam surfaces are convex.

19. The package set forth in claim 17 wherein said cam surfaces are part-helical.

20. The package set forth in claim 19 wherein said lugs have part-helical upper surface portions for riding over said part-helical cam surfaces of said projections.

21. The package set forth in claim 13 wherein said means include a plurality of external thread segments, each having a said pocket.

22. A method of making a closure and container package that includes the steps of:

(a) providing a container having an end with an open mouth surrounded by a container wall having a central axis, an external ledge extending around said container wall and spaced from said open mouth, said ledge having an axially facing surface that adjoins a radially outwardly facing surface of said container wall, and means on said ledge including at least one pocket for securing a closure to said container, and (b) providing a closure a closure that includes a base wall, a peripheral skirt coupled to said base wall, at least one internal lug on said skirt for receipt in said at least one pocket, an annular wall that extends from said base wall for plug-sealing receipt within said mouth when said skirt is received over said end of said container, and at least one spring element that extends from said base wall adjacent to said skirt radially inwardly and axially within said skirt, said spring element being adapted to engage said axially facing surface of said ledge and to slide radially inwardly along said surface as said at least one lug is moved into said pocket to bias said lug into said pocket, said radially outwardly facing surface of said container wall adjacent to said ledge axially facing surface functioning as a stop to prevent over-compression of said spring element and to prevent engagement of said spring element with said annular wall on said closure.

* * * * *